US007956708B2

(12) United States Patent
Bates et al.

(10) Patent No.: US 7,956,708 B2
(45) Date of Patent: Jun. 7, 2011

(54) WIDEBAND DIELECTRIC WAVEGUIDE FILTER

(75) Inventors: David Allen Bates, Fayetteville, NY (US); Mesut Gokten, Syracuse, NY (US)

(73) Assignee: Dielectric Laboratories, Inc., Cazenovia, NY (US)

( * ) Notice: Subject to any disclaimer, the term of this patent is extended or adjusted under 35 U.S.C. 154(b) by 0 days.

(21) Appl. No.: 12/353,442

(22) Filed: Jan. 14, 2009

(65) Prior Publication Data

US 2009/0231064 A1 Sep. 17, 2009

Related U.S. Application Data

(63) Continuation of application No. PCT/US2007/075153, filed on Aug. 3, 2007.

(60) Provisional application No. 60/835,642, filed on Aug. 4, 2006.

(51) Int. Cl.
*H01P 1/208* (2006.01)
*H01P 7/06* (2006.01)

(52) U.S. Cl. ..... 333/212; 333/230

(58) Field of Classification Search ..... 333/202, 333/204, 205, 208–212, 219.1, 230–233
See application file for complete search history.

(56) References Cited

U.S. PATENT DOCUMENTS

| | | | | |
|---|---|---|---|---|
| 4,837,535 | A * | 6/1989 | Konishi et al. | 333/210 |
| 5,614,875 | A * | 3/1997 | Jang et al. | 333/202 |
| 6,060,965 | A * | 5/2000 | Sung et al. | 333/202 |
| 6,380,824 | B1 | 4/2002 | Nishijima et al. | |
| 6,677,837 | B2 | 1/2004 | Kojima et al. | |
| 2001/0024147 | A1 * | 9/2001 | Arakawa et al. | 333/135 |
| 2002/0039058 | A1 | 4/2002 | Sano et al. | |

* cited by examiner

*Primary Examiner* — Benny Lee
*Assistant Examiner* — Gerald Stevens
(74) *Attorney, Agent, or Firm* — Burr & Brown

(57) ABSTRACT

A waveguide-type dielectric filter suitable for wideband filter applications made of a metallized dielectric material is provided. The filter includes two or more mutually coupled resonators disposed in a longitudinal manner. The coupling between adjacent resonators is provided and adjusted by slots or through holes. The dielectric block is covered with metal ground coating with the exception of an uncoated area at the input and output that creates two contact pads on one surface of the dielectric block that are electrically isolated from the metal ground coating. Metallized blind holes are formed on the opposing surface of the dielectric block with respect to the contact pads. These blind holes effectively move the ground plane closer to the contact pad, which, in turn increases the coupling between the input and output resonators and external circuitry, which is essential for building wide bandwidth band pass filters.

18 Claims, 5 Drawing Sheets

WIDEBAND DIELECTRIC WAVEGUIDE FILTER

FIELD OF THE INVENTION

The present invention relates to a waveguide-type dielectric filter suitable for narrow to wideband filter applications which is made from one or more blocks of dielectric material, such as a ceramic material.

BACKGROUND OF THE INVENTION

U.S. Pat. No. 6,566,986 discloses a dielectric filter composed of three or more rectangular parallel-piped dielectrics connected in line or integrally formed on a dielectric block. FIG. 7 illustrates one such waveguide-type dielectric filter. The filter comprises a metal coated rectangular parallel-pipe shaped dielectric block with input/output contact pads 112 made of a conducting film 71 as island-type contact pads surrounded by the insulating material of the dielectric block, and through holes 72 interposed between adjacent resonators 114 to form the resonators and coupling irises. As one skilled in the art would understand, the size and location of the contact pads 112, together with the size of the coupling irises, determine the bandwidth of the filter. This type of conventional filter does not provide a substantially wide bandwidth which is required for many applications, such as microwave communications, Radar, or other applications for which devices having frequency selective transmission characteristics are desired.

In order to obtain a wideband filter, the coupling of the filter to the external circuitry needs to be increased, which has typically been achieved by using a larger contact pad. However, since the size of the contact pad must remain smaller than the broad face of the resonator itself on which the pad is formed, it is still not possible to provide wide-bandwidth designs with this kind of structure. Another method of increasing the coupling involves reducing the height of the dielectric block in the thickness direction. Ultimately, however, this technique is likewise not practically useful, because the reduced thickness of the dielectric block needed to provide the increased coupling also reduces the resonator Q, which, in turn, undesirably increases filter insertion loss.

The spurious band rejection is also serious issue related to waveguide-type filters. The resonators of the filters have high order resonance modes occurring at high frequencies which result in spurious (and normally undesired) pass-bands. These higher order mode resonances introduce undesired transmission at these frequencies, and also limit the ultimate rejection of the filter.

In view of the above, it would be desirable to provide a waveguide filter that can provide a wide pass-band without negatively affecting the resonator Q, and which has an improved spurious response.

SUMMARY OF THE INVENTION

It is an object of the present invention to overcome the drawbacks associated with the prior art discussed above, in order to provide a waveguide filter having a wide pass-band without negatively affecting the resonator Q and also having an improved spurious response.

In order to increase the coupling of the filter to the external circuitry, the size of the contact pad must be increased, or the thickness of the filter must be reduced. These steps are not desirable for the reasons explained above. According to the present invention, however, metallized blind holes which are aligned with the contact pads are provided to increase the coupling to the desired level. These blind via holes start from, or open at the surface of the dielectric block that opposes the surface on which the contact pads are provided, and terminate at a position within the dielectric block, thus avoiding electrical connection to the contact pads. In this manner, the thickness of the dielectric block is reduced only in the target vicinity of the contact pads, which moves the ground plane closer to the contact pad, and thus increases the amount of coupling. Since the overall thickness of the dielectric block is not reduced, the Q of the resonator does not suffer appreciably.

Resonators having this type of structure are called cavity or waveguide resonators. Cavity resonators exhibit not only one, but a number of harmonic resonances. Inevitably, filters built from these resonators exhibit undesired signal transmission at these harmonic resonances. For these types of resonators, the first harmonic resonance usually occurs at around 1.6 times the fundamental resonance, which may be unacceptable for some applications. The present inventors discovered that blind holes improve the coupling of the resonator also help to control the harmonics of the resonator. The first harmonic of the input/output resonators can be shifted to a higher frequency, that is, away from the fundamental resonance, to improve the spurious response of the filter.

According to one embodiment of the present invention, a wideband dielectric waveguide cavity filter is provided, including a dielectric body comprising a dielectric material and having two or more resonator sections. The dielectric body has a first surface and an opposed second surface defining a thickness dimension of the dielectric body therebetween, a pair of transversely opposed side surfaces extending in a longitudinal direction of the dielectric body and defining a length dimension of the dielectric body. A pair of longitudinally opposed end surfaces extend in a transverse direction of the dielectric body and define a width dimension of the dielectric body. The filter also includes two or more resonators that are longitudinally disposed along the longitudinal direction of the dielectric body so that adjacent ones of the two or more resonators are coupled to one another via a coupling mechanism. The dielectric body is substantially covered with a metal ground coating to define at least two uncoated regions surrounding a contact pad formed on one of the first surface and the opposed second surface of the dielectric body so that the contact pads are electrically isolated from the metal ground coating. One or more metallized blind holes are also provided, extending a distance from an opening on a metallized portion of the other one of the first surface and second surfaces of the dielectric body, e.g., the main or broad face surface of the dielectric body opposite the one which the contact pads are formed, toward a blind end thereof in the thickness direction of the dielectric body. The metallized blind holes, also interchangeably referred to herein as blind vias, effectively decrease a distance between a ground plane and the contact pads so as to effectively increase coupling between the resonators and external circuitry.

Preferably, the coupling mechanism coupling adjacent resonators comprises one of (i) a pair of transversely opposed, metallized slots passing through the dielectric body in the thickness direction thereof proximate a respective one of the side surfaces thereof, and (ii) a metallized through hole passing through at least a central portion of the dielectric body in the thickness direction thereof.

According to one aspect of the present invention, the pair of transversely opposed, metallized slots are provided, which pass through the dielectric body in the thickness direction thereof from an opening formed on a metallized portion of the first surface of the dielectric body toward an opposed opening on a metallized portion of the second surface of the dielectric body. Each metallized slot extends a distance in the transverse direction of the dielectric body from a respective one of the openings on a respective one of the first and second surfaces of the dielectric body toward a blind end thereof to define a length dimension of the slots. Each slot extends a distance in the longitudinal direction of the dielectric body to define a width dimension of the slot.

According to another aspect of the present invention, metallized through holes are provided, which pass through at least a central portion of the dielectric block in the thickness direction thereof from an opening formed on the first surface of the dielectric block to an opposed opening on the second surface of the dielectric body. The metallized through hole has a length dimension defined in the transverse direction of the dielectric block and a width dimension defined in the longitudinal direction of the dielectric body.

According to yet another aspect of the present invention, the filter further comprises a metallized, transverse slot defining an opening formed in the other one of the first surface and second surfaces of the dielectric body (e.g., the surface opposite the surface on which the contact pads are formed) in at least a central portion of at least an intermediate one of the resonators. Preferably, each transverse slot spans the width dimension of the dielectric body and extends from an opening on one of the longitudinal sides of the dielectric body toward an opposed opening on the opposed longitudinal side of the dielectric body.

It is preferred that the wideband dielectric waveguide cavity filter according to any of the above mentioned aspects of the present invention comprises at least three resonators.

According to another embodiment of the present invention, a dielectric waveguide cavity filter is provided, including a sintered dielectric block having an outer surface extending from a first end to an opposed second end thereof in a longitudinal direction and having a width defined in a transverse direction that is substantially perpendicular to the longitudinal direction. A metal layer substantially covers the outer surface of the sintered dielectric block and defines a pair of longitudinally opposed, electrically isolated contact pads on a first main portion of the outer surface of the sintered dielectric block proximate a respective one of the first and the second ends of the dielectric block. A pair of longitudinally opposed, metallized blind holes extend inwardly from an opposed second main portion of the outer surface of the sintered dielectric block and directly oppose a respective one of the contact pads on the first main portion. The filter also includes a plurality of adjacent resonator sections coupled to one another through coupling means disposed between adjacent ones of the resonator sections. The coupling means is defined by one of (i) a pair of transversely opposed, metallized slots that extend inwardly toward one another in the transverse direction from an opening on respective ones of a first side portion and a transversely opposed second side portion of the outer surface of the sintered dielectric block and (ii) a metallized through hole passing from an opening on the first main portion through the sintered dielectric block toward an opposed opening on the second main portion of the outer surface of the sintered dielectric block.

According to one aspect of this embodiment, a first one of the pair of contact pads and a first one of the metallized blind holes are disposed on opposite main surfaces of a first outermost one of the resonator sections proximate one of the first and the opposed second ends of the dielectric block, while the other one of the pair of the contact pads and the other one of the blind holes are disposed on opposite main surfaces of a second outermost one of the resonator sections proximate the other one of the first and the opposed second ends of the sintered dielectric block.

According to yet another aspect of the present invention, the filter further comprises at least one metallized, transverse slot defining an opening formed in the second main portion of the outer surface of the dielectric block, e.g., on the main portion of the outer surface opposing the main portion on which the contact pads are formed, in at least a central portion of at least one of the resonator sections. Its is preferred that each transverse slot spans the width dimension of the dielectric block and extends from an opening on one of the transversely opposed side surfaces of the dielectric block toward an opposed opening on the other one of the transversely opposed side surfaces of the dielectric block. Preferably, the filter comprises at least three resonator sections, and the at least one transverse slot is provided in at least a central portion of an intermediate one of the resonator sections located between resonator sections defining outermost resonator sections nearest end faces of the a sintered dielectric block.

The term wideband used herein refers to the pass-band width frequency range divided by the center frequency of the pass-band, in percent. For example, a bandwidth 10 to 11 GHz has a center frequency of 10.5 GHz. The % BW=100%×(11−10)/10.5=9.52%. In the context of waveguide cavity filters, which are normally applied to bandwidths of approximately 0.5% to 10%, the prior art approach was limited to bandwidths of approximately 3% or less. The blind cavity according to the present invention enables sufficiently high levels of coupling from external circuitry to the filter to achieve bandwidths of 10% or greater. The geometry of the prior art filter limited bandwidth due to insufficient coupling to the external circuitry.

The wideband dielectric waveguide filters according to the present invention can be used in connection with microwave communications, radar or other applications wherein devices with frequency selective transmission characteristics are desired, specifically in the frequency range of 2 to 40 GHz. Both individual filters and multi-filter constructs such as duplexers can be realized using the present invention. Using high dielectric constant materials enables the miniaturization of wavelength dependent devices, which offers a size reduction in all three dimensions as well as a significantly lower weight compared to the more common air-filled cavity waveguide filters. The weight and volume reduction factors are typically on the order of 100:1 using dielectric materials with relative dielectric constants of approximately 23. In addition, the physical form of the invention allows the filters to be integrated into microwave systems by preferred means such as solder surface mount assembly technology. Frequently, the air filled cavity waveguide filters that would be replaced by the present invention ultimately control the size, weight and construction of the systems in which they are used. Along those lines, it is possible to realize both lower cost systems and significantly miniaturized systems.

DETAILED DESCRIPTION OF THE INVENTION

Various embodiments of the present invention are described in this section, however, the present invention is not limited to the embodiments shown herein.

Figure 1:
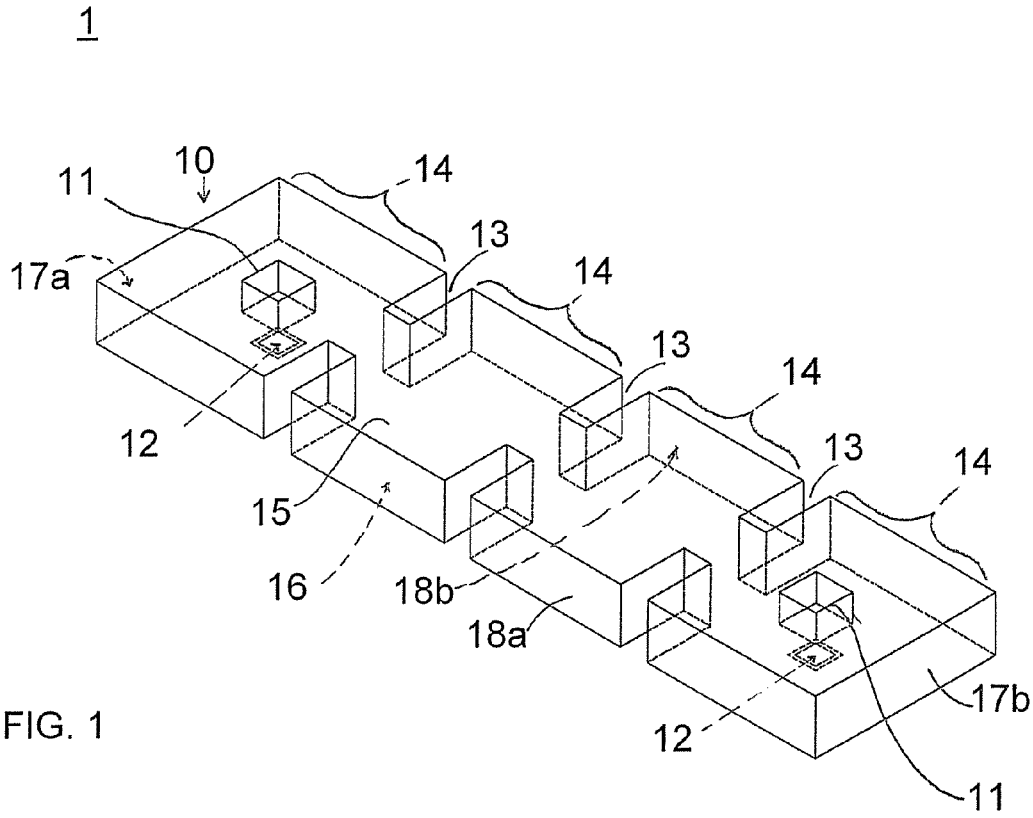
FIG. 1 is a perspective view of a dielectric waveguide filter according to one embodiment of the present invention.
Figure 2:
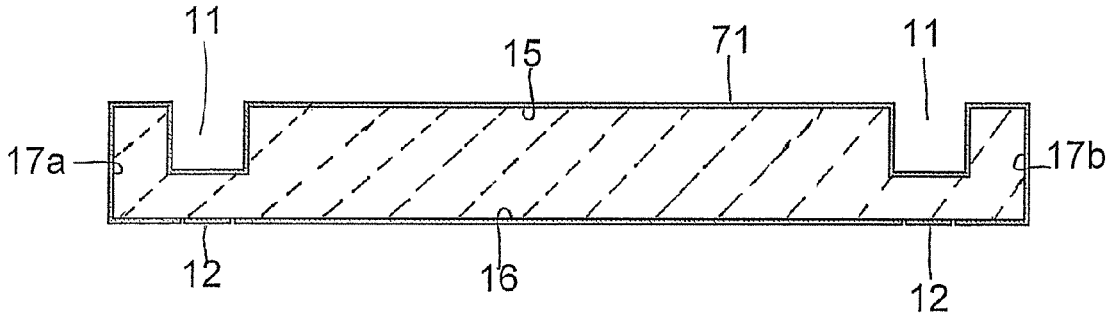
FIG. 2 is a cross-sectional side view of the filter shown in FIG. 1.

FIG. 1 is a perspective view of a dielectric waveguide filter 1 according to one embodiment of the present invention. FIG. 2 is a cross-sectional side view of the filter 1 shown in FIG. 1, taken along the longitudinal center-line thereof.

The filter 1 comprises a sintered dielectric body, shown here as a rectangular block of dielectric material 10 having a metal-coating, metallization 71, formed on the outer surfaces thereof. The dielectric block 10 a thickness dimension defined between an upper surface 15 and an opposed bottom surface 16 thereof. A pair of longitudinally opposed end surfaces 17*a* and 17*b* extend in the transverse direction of the dielectric block 10 and define a width of the dielectric block 10, and a pair of transversely opposed side surfaces 18*a* and 18*b* extend along the longitudinal direction of the dielectric block and define a length dimension of the dielectric block 10.

The filter 1 includes plurality of longitudinally spaced resonators 14 that are mutually coupled to one another through coupling irises, which, in this embodiment, are defined by slots 13. The broad faces of the individual resonators correspond to the respective portions of the top 15 and bottom 16 surfaces of the dielectric block 10. These slots 13 are open on the longitudinal sides 18*a*, 18*b* of the dielectric block 10 and extend a distance in the transverse (or width) direction of the dielectric block 10 to define a depth of the slots 13, and also pass through the thickness direction of the dielectric block 10 between openings on the upper surface 15 of the dielectric block 10 and the bottom surface 16 thereof. The dimensions of the width of the slots 13, which extends in the longitudinal direction of the block 10, and the depth of the slots, which extends in the transverse or width direction of the dielectric block, control the coupling between resonators and hence the bandwidth of the filter.

For instance, increasing the slot width or depth, individually or in combination, decreases the coupling level between corresponding adjacent resonators, and a decrease in the resonator coupling level results in a reduction of filter bandwidth. On the other hand, a smaller slot width or depth increases the coupling between adjacent resonators. For filter bandwidths less than approximately 3%, the present invention embodiment of FIG. 3, which is described in more detail below, is preferred over the embodiment shown in FIG. 1. With reference to FIG. 1, bandwidths less than 3% typically result in slot depths which effectively reduce the cross-sectional filter width by 50% or more in the coupling iris regions defined by slots 13, which mechanically weakens the part as a whole.

The contact pads 12, which are formed on the bottom surface 16 of the dielectric block 10 proximate the longitudinally opposed ends 17*a*, 17*b* thereof, define the input and output of the filter 1. The contact pads 12 are island-type input/output pads that are electrically isolated from the ground metal coating and are surrounded by an annular ring where the metal coating has been removed from (or not formed on) the bottom surface 16 of the filter. The area and location of the pads 12 also control the bandwidth of the filter. For example, a larger pad located closer to the center of the resonator provides larger bandwidth. Pad linear dimensions are preferably less than 30% of the broad face dimensions of an individual resonator in order to minimize Q degradation of the input and output resonators.

Two blind cavities 11 are also provided, which open on the top surface 15 of the dielectric block 10 and extend a distance in the thickness direction of the dielectric block 10 toward the terminal (blind) ends thereof to define a depth of the blind cavities 11. The centers of the blind cavities 11 are vertically aligned with the contact pads 12 in the thickness direction of the dielectric block 10, and typically centered. The depth of the blind cavities 11 in conjunction with the recessed area and the contact pad area control the coupling level between the filter input and output resonators, and the external circuit. An increase in any of the following parameters results in an increase in the coupling level: (1) the depth of blind cavity 11; (2) the area of the bottom surface of the blind cavity; or (3) the area of the contact pad 12. The pass-band bandwidth of a filter is directly proportional to the resonator coupling levels, thus a deeper cavity provides a wider bandwidth. The depth of the blind cavity and the area of the blind cavity bottom surface also control the second harmonic response of the input/output resonators. A deeper cavity or an increase in the area of the cavity bottom surface shifts the first harmonic resonance frequency further away from the fundamental resonance frequency resulting in reduced transmission in spurious bands. The depth of the blind cavity that are preferably approximately 50% of the height or thickness dimension of the filter to enable bandwidths up to 10%. In this low to moderate bandwidth region, the higher Q of cavity resonators offers significantly lower insertion loss for frequencies in the pass-band range compared to lumped element L-C filters or micro strip-line filters.

Figure 3:
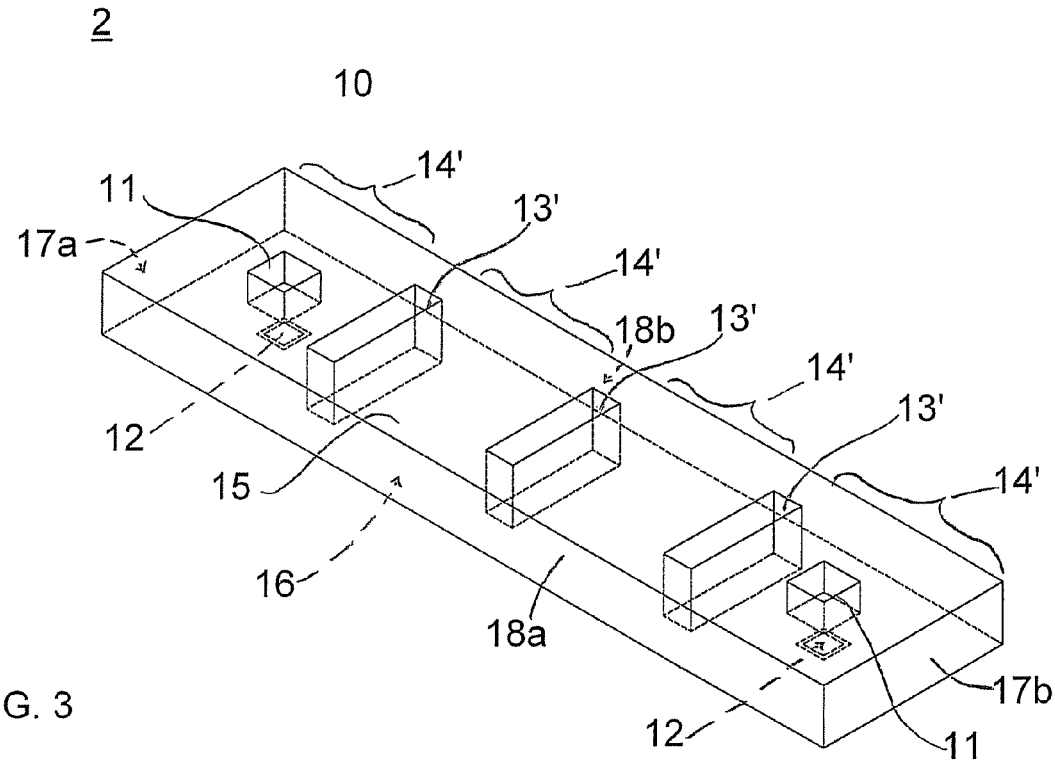
FIG. 3 shows a dielectric waveguide filter according to another embodiment of the present invention.

Another embodiment of the present invention is shown in FIG. 3, wherein like elements have been designated with like reference numerals. The filter 2 is similar to the filter 1 shown in FIG. 1, with the exception of the coupling mechanism. In the filter 2, the coupling irises between adjacent resonators 14' are defined by metal coated through holes 13' formed passing through the thickness direction of the dielectric block 10 instead of vertical side slots 13. Wider through holes 13' provide narrower bandwidths, wherein the slot width is defined in the transverse direction with respect to the longitudinal center-line of the filter. The resonators 14 and 14' forming the waveguide filters 1 and 2 shown in the embodiments of FIGS. 1-3 are uniform impedance resonators (UIRs). It should be understood that although the embodiments shown in FIGS. 1 and 3 relate to 4 pole filter configurations, the present invention is equally applicable to two or three pole filter designs.

As mentioned above, the resonant frequencies of these resonators are determined by the length and width dimensions of the resonator sections, which corresponds to the length and width dimensions of the rectangular regions between coupling iris regions 13, 13'. Even in view of the above, however, better control of the higher order resonances is desired in order to improve the spurious performance of these types of filters.

One way to improve the spurious performance of these filters is to use stepped impedance resonators (SIRs) instead of UIRs. A SIR is usually made of at least three sections, which can be modeled by a transmission line with three sections, such as that shown in the schematic representation of a single SIR resonator in FIG. 4. The characteristic impedance of the inner section $Z_2$, which corresponds to the slot region 47 in FIG. 5, is not equal to the characteristic impedance of outer sections $Z_1$, which correspond to the regions of maximum thickness in the resonator sections. The physical length $l_1$, $l_2$ of each section and the ratio of impedances $Z_2/Z_1$ can be adjusted to control the fundamental and higher order modes of the resonator.

FIG. 5 shows an example according to this embodiment of the present invention. Compared to the filter 1 shown in FIG. 1, the filter 3 shown in FIG. 5 includes additional transverse slots 47 formed in the intermediate cavity resonators 141. The slots 47 are open on the transversely opposed longitudinal side surfaces 18*a*, 18*b* of the dielectric block 100 and on the upper surface 15 thereof, and span the transverse distance between the opposed longitudinal side surfaces (i.e., the width) of the dielectric block 100. These slots 47 serve to reduce the height of the resonators and reduce the characteristic impedance in the slot region. With the introduction of these slots, the previous UIRs become SIRs.

Figure 4:
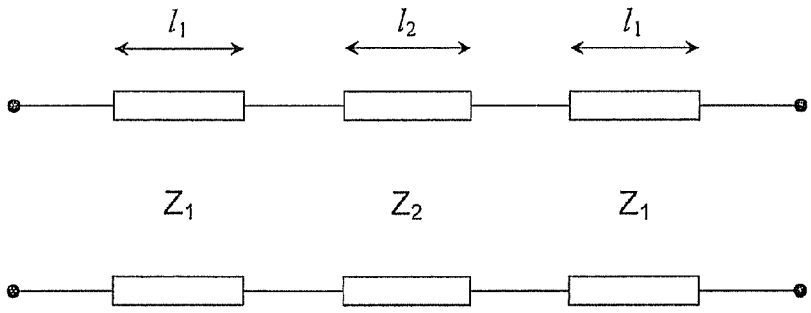
FIG. 4 shows a transmission line with three sections.
Figure 5:
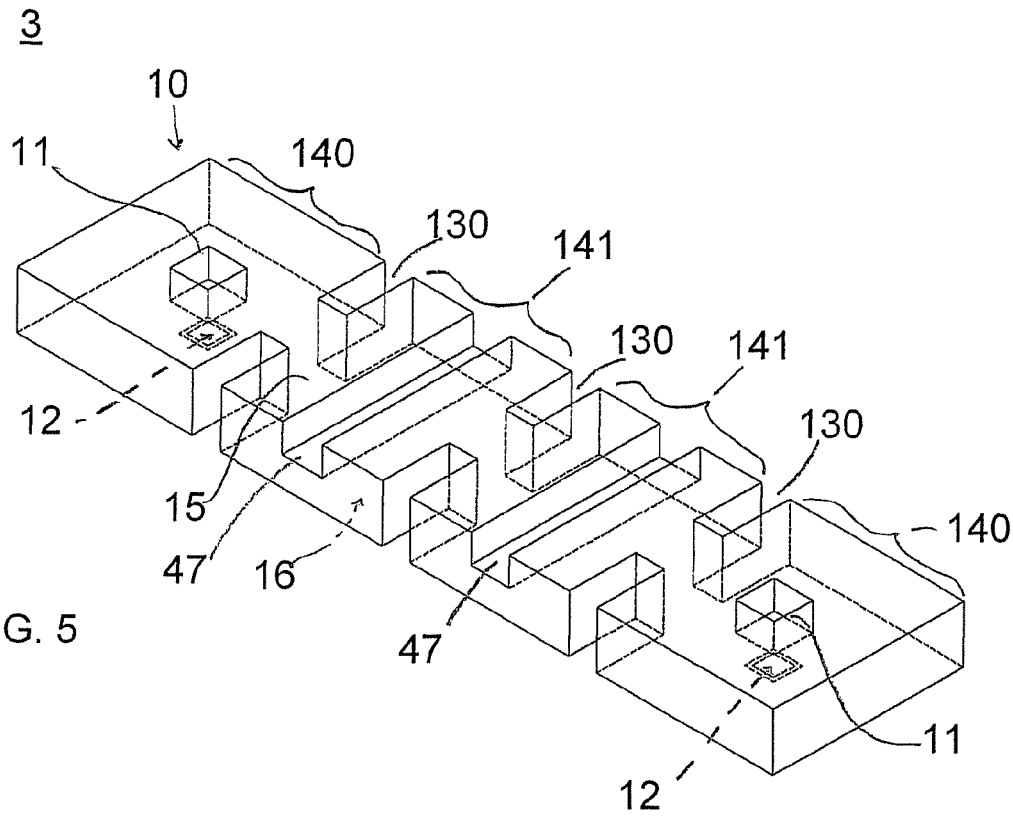
FIG. 5 shows another embodiment of the present invention.

Specifically, the impedance of the slotted section, which corresponds to $Z_2$ shown in FIG. 4, is lower than the impedance of the outer sections, which correspond to $Z_1$ in FIG. 4, which in turn shifts the first harmonic resonance frequency of this SIR to higher frequencies. The SIRs are also smaller compared to the UIRs, and as such, filters made of SIRs offer the benefit of being more compact.

Figure 6:
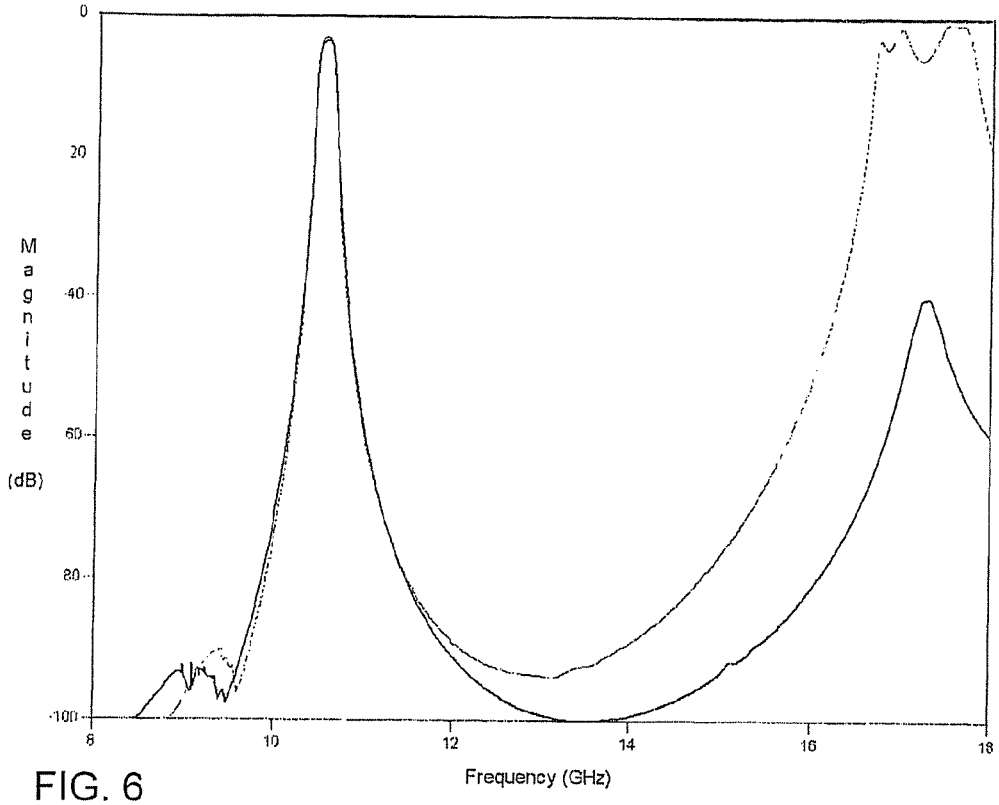
FIG. 6 is a graph showing a comparison between the spurious response of a SIRs dielectric waveguide filter and a UIRs dielectric waveguide filter.
Figure 7:
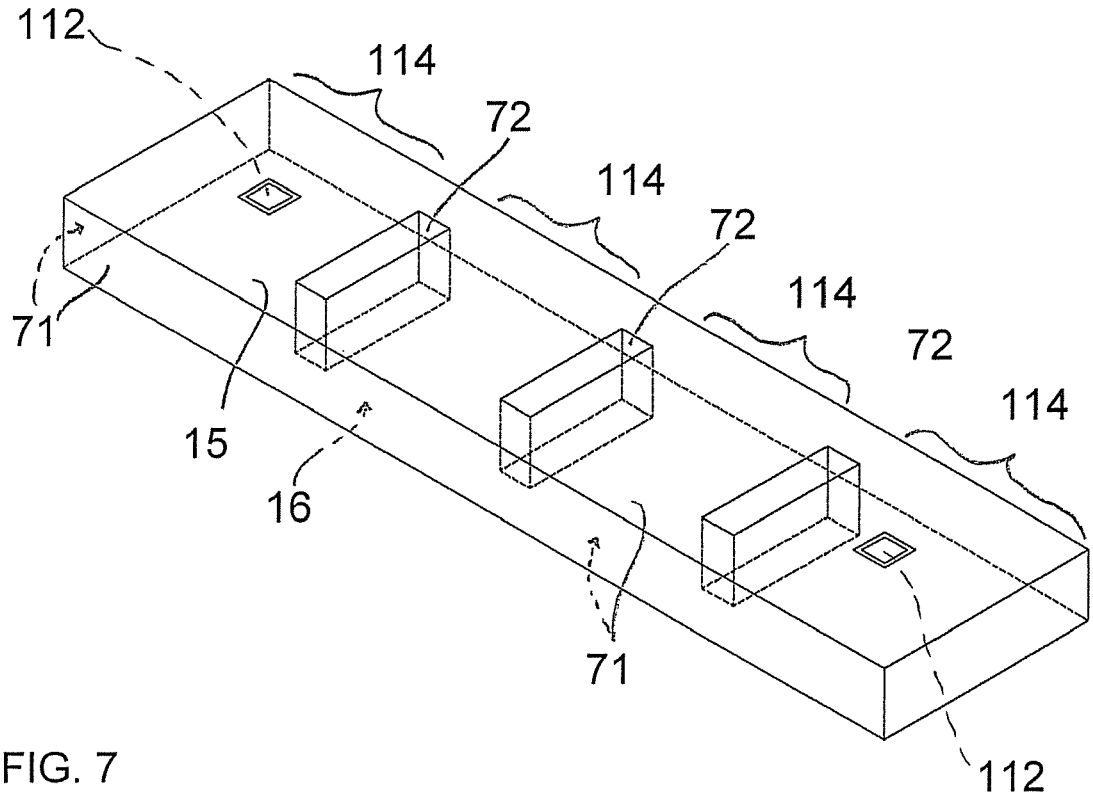
FIG. 7 PRIOR ART
FIG. 7 is a perspective view of a prior art dielectric filter.

FIG. 6 is a graph showing a comparison between the spurious response of two dielectric waveguide filters, one of which includes SIRs and other of which includes UIRs. The spurious response of the SIR filter is represented by the solid line in FIG. 6, and is comparably advanced. Filters constructed of either UIR or SIR resonators have nearly identical frequency responses proximate the fundamental pass-band at 10.5 GHz, however, in the vicinity of 17 GHz, the spurious response of the UIR filter, represented by the broken line in FIG. 6, provides very little attenuation, whereas the filter made of SIR resonators attenuates the spurious response by approximately 40 dB, which is a very significant improvement.

In the case of SIRs and UIRs according to the present invention, examples of suitable materials for the dielectric block include temperature stable, low loss dielectrics with characteristics commensurate with dimensional precision, stability of physical dimensions and dielectric constant over the operating temperature range. For example, in some applications for filter bandwidths around 1%, physical dimensions, dielectric constant variations between material lots and over varying temperature must be sufficiently low to ensure that the parts do not require subsequent tuning in order for the filter to perform in the desired manner at the correct frequency and over the operating temperature range. The material for forming the filter, and the processes, as well, require high precision, both with respect to fabrication wise and dimensionally over temperature, and the dielectric constant needs to be known and stable. The dielectric loss tangent also needs to be low, typically less than 0.0005, which corresponds to a dielectric Q of 2000, which is a thresh hold point at which resonator Q and filter losses are seen to be impacted. It is preferred that the dielectric Q is large enough, on the order of about 5000, to ensure that the dielectric loss would be small compared to metal losses.

Preferably, the material for the dielectric block 10 is a rigid ceramic material such as alumina, magnesium titanate, calcium titanate and zirconium titanate, which are known to exhibit temperature stability, as described above, and a high Q.

The dielectric block is preferably a sintered ceramic body that can be formed using any known ceramic processing techniques. One example of a suitable forming methods includes green-sheet tape processing, hole punching, screen printing of conductor inks, lamination and cutting into single parts followed by application of conductive metal inks such as silver and then sintered to form a rigid metal coated ceramic filter. Using the green sheet lamination technique, however, shrinkage of the body during sintering must be taken into account with respect to forming the dimensions of the blind vias, slots or other geometrical features in the green state. Accurate repeatability and precision control of these dimensions is difficult to achieve using the green sheet method. This can be problematic in view of the relationship between the dimensions of the resonators and the filter performance. As explained above, is important to control the dimensions of the slots, through holes and blind vias dimensions to provide the desired filter characteristics and response behaviors.

Preferably, the dielectric block is formed from a two solid substrates made of a suitable sintered ceramic material (examples of which are mentioned above). The substrates are lapped and polished to provide smooth planar mating surfaces. One substrate is laser machined to form through holes in the ceramic, which will correspond to the size and location of the blind vias after the substrates are joined, as described below. Suitable laser processes include $CO_2$ lasers to offer precise dimensions and locations for the holes that are the future blind vias. The two substrates are then bonded together, preferably by thermal fusing at temperatures of around 1000° C. to 1400° C. for 1 to 4 hours in an oxygen atmosphere with an applied pressure of 1-2 psi and then cooled at a rate of about 5° C./minute. In any event, the cooling rate must be slow enough to minimize internal stresses.

The resultant dielectric block includes precisely dimensioned blind vias in the desired locations. The sintered dielectric block is then precision machined using a laser, for example, to form slots or through holes having the correct dimensions, without needing to account for subsequent shrinkage, as in the case with the green sheet lamination technique.

After the block and its structural features have been formed, the bock is coated with a metal. Examples of suitable materials for the metal coating or metallization 17 applied to the surface of the dielectric block 10 include, but are not limited to copper, silver, gold or other suitable coatings of high electrical conductivity commensurate with achieving high Q resonators for filters. The material for the metal coating is preferably thin film gold and preferably includes a suitable adhesion layer such as titanium between the gold layer and the dielectric ceramic block. To achieve maximum Q, the metal film should be a minimum of 3 skin depths thick at the operating frequency. For a 10 GHz filter, the thin gold film thickness should be at least 100 micro-inches. Suitable methods for forming the metallization layer on the dielectric block include, but are not limited to the use of various thick film conductor inks which can be spray coated or screen printed, or various thin film deposition methods including sputtering or evaporation, or various plating methods.

To form the contact pads, a precise area of the metallization is removed using photolithography and chemical etching to define the dimensions of the contact pads and provide the insulating areas surrounding the contact pads. The contact pads are essentially conductive islands made of the metal coating material, and the area surrounding the contact pads is an exposed portion of the surface of the dielectric block. The contact pads and insulating island formation can also be achieved by masking or sequential screen printing steps, as would be understood by those skilled in the art.

The present invention is further explained herein by way of example, however, it should be understood that the present invention is in no way limited to the embodiment of the example.

EXAMPLE

A 4 pole Chebyshev response band-pass waveguide cavity filter for operation at 10.5 GHz was fabricated using a proprietary Magnesium titanate, temperature stable ceramic with a relative dielectric constant of 23 to have the structure shown in FIG. 3. The overall dimensions of the part were 0.68×0.19×0.030 inches. The filter was fabricated from two layers polished ceramic layers, each 0.015 inch thick, in order to form blind cavities 11 with a depth of 0.015 inches. The blind cavities or blind vias 11 had dimensions of 0.02×0.02 inches and were formed directly above the contact pad islands 12, positioned on the longitudinal center-line of the filter at a distance of 0.045 inches from the end faces of the filter. Through holes forming post coupling irises 13' were formed on the longitudinal center-line of the filter with dimensions of 0.036×0.053 inches and 0.036×0.058 inches with a via center-to-center spacing of 0.180 inches, defining the longitudinal dimension of the resonator sections 14' shown in FIG. 3.

The entire exterior of the filter was metallized using thin film gold having a thickness of 100 micro-inches, with the exception of the dielectric isolation ring surrounding the island contact pads, which was 0.005 inches wide on each side.

Figure 8:
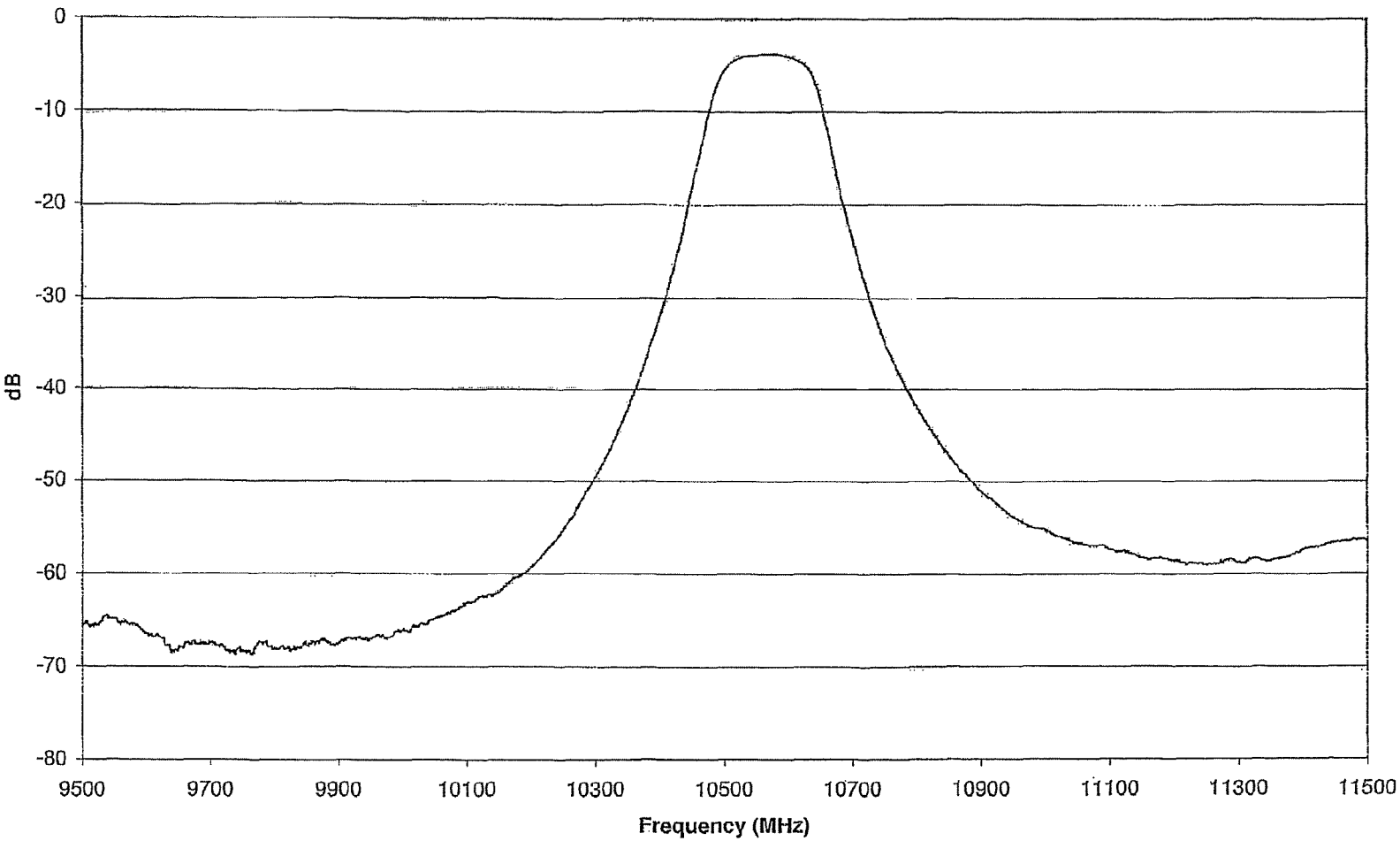
FIG. 8 is a graph showing the frequency response data of the 10.5 GHz band-pass filter according to the Example which was obtained using a microwave vector network analyzer over a frequency range of 9.5 to 11.5 GHz.

The resultant filter was tested using a microwave vector network analyzer over the frequency range of 9.5 to 11.5 GHz. The measured insertion loss versus frequency results are shown in FIG. 8. As shown, the filter has a pass-band center frequency of 10.56 GHz, with a 0.15 GHz bandwidth and 3.9 dB insertion loss at the center frequency. The attenuation of frequencies outside the pass-band reaches values as large as 55 dB on both sides of the pass-band.

What is claimed is:

1. A wideband dielectric waveguide cavity filter comprising:

a dielectric body comprising a sintered dielectric material and having two or more resonator sections, said dielectric body having a first surface and an opposed second surface defining a thickness dimension of said dielectric body therebetween, a pair of transversely opposed side surfaces extending in a longitudinal direction of said dielectric body between longitudinally opposed first and second end surfaces of said dielectric body and defining a length dimension of said dielectric body, and said longitudinally opposed first and second end surfaces extending in a transverse direction of said dielectric body and defining a width dimension of said dielectric body;

said two or more resonator sections including two or more resonators longitudinally disposed along the longitudinal direction of said dielectric body so that adjacent ones of said two or more resonators are coupled to one another via a coupling mechanism, wherein said coupling mechanism coupling said adjacent ones of said two or more resonators comprises one of (i) a pair of transversely opposed, metallized slots passing through said dielectric body in the thickness direction thereof proximate a respective one of said side surfaces thereof, and (ii) a metallized through hole passing through at least a central portion of said dielectric body in the thickness direction thereof;

a metal ground coating substantially covering said dielectric body to define at least two uncoated regions surrounding a pair of contact pads formed on one of said first surface and said second surface of the dielectric body so that said contact pads are electrically isolated from said metal ground coating and from one another;

at least one metallized, transverse slot defining an opening formed in the other one of said first surface and said second surface of said dielectric body in at least a central portion of at least one of said resonators, wherein said at least one metallized, transverse slot spans the width dimension of said dielectric body and extends from an opening on one of said longitudinal sides of said dielectric body toward an opposed opening on the opposed longitudinal side of said dielectric body; and one or more metallized blind holes extending a distance from an opening on a metallized portion of the other one of said first surface and said second surface of said dielectric body toward a blind end thereof in the thickness direction of said dielectric body;

whereby said one or more metallized blind holes effectively decrease a distance between a ground plane and said pair of contact pads so as to effectively increase coupling between said two or more resonators and external circuitry.

2. A wideband dielectric waveguide cavity filter comprising:

a sintered dielectric block having an outer surface extending from a first end to an opposed second end thereof in a longitudinal direction and having a width defined in a transverse direction that is substantially perpendicular to said longitudinal direction;

a metal layer substantially covering said outer surface of said sintered dielectric block and defining a pair of longitudinally opposed, electrically isolated contact pads on a first main portion of said outer surface of said sintered dielectric block proximate a respective one of said first and said second ends of said dielectric block;

a pair of longitudinally opposed metallized blind holes extending inwardly from an opposed second main portion of said outer surface of said sintered dielectric block and directly opposing a respective one of said pair of contact pads on said first main portion;

a plurality of adjacent resonator sections coupled to one another through coupling means disposed between adjacent ones of said plurality of adjacent resonator sections, said coupling means being defined by one of (i) a pair of metallized, transversely opposed slots that extend inwardly toward one another in the transverse direction from an opening on respective ones of a first side portion of said outer surfaces of said sintered dielectric block and a transversely opposed second side portion of said outer surface of said sintered dielectric block and (ii) a metallized through hole passing from an opening on said first main portion through said sintered dielectric block toward an opposed opening on said second main portion of said outer surface of said sintered dielectric block; and at least one metallized, transverse slot defining an opening formed in said second main portion of said outer surface of said sintered dielectric block in at least a central portion of at least one of said plurality of adjacent resonator sections, wherein each said at least one metallized, transverse slot spans the width dimension of said sintered dielectric block and transversely extends from an opening on one of the transversely opposed first and second side portions of said sintered dielectric block toward an opposed opening on the other one of the transversely opposed first and second side portions of said sintered dielectric block.

3. A wideband dielectric waveguide cavity filter comprising:

a dielectric body comprising a sintered dielectric material and having two or more resonator sections, said dielectric body having a first surface and an opposed second surface defining a thickness dimension of said dielectric body therebetween, a pair of transversely opposed side surfaces extending in a longitudinal direction of said dielectric body between longitudinally opposed first and second end surfaces of said dielectric body and defining a length dimension of said dielectric body, said longitudinally opposed first and second end surfaces extending in a transverse direction of said dielectric body and defining a width dimension of said dielectric body;

wherein said two or more resonator sections are defined by said dielectric body and bounded by a metal ground coating substantially covering all of said surfaces of said dielectric body, said two or more resonator sections being longitudinally disposed along the longitudinal direction of said dielectric body so that adjacent ones of said two or more resonator sections are transversely separated from one another and coupled to one another via a coupling mechanism;

wherein said metal ground coating substantially covering all of said surfaces of said dielectric body defines at least two uncoated regions surrounding a pair of contact pads formed on one of said first surface and said second surface of the dielectric body so that said pair of contact pads are electrically isolated from said metal ground coating and from one another; and one or more metallized blind holes extending a distance from an opening on a metallized portion of the other one of said first surface and said second surface of said dielectric body toward a blind end thereof in the thickness direction of said dielectric body;

whereby said one or more metallized blind holes effectively decrease a distance between a ground plane and said pair of contact pads so as to effectively increase coupling between said two or more resonator sections and external circuitry.

4. The wideband dielectric waveguide cavity filter according to claim 3 wherein said coupling mechanism coupling said adjacent ones of said two or more resonator sections comprises one of (i) a pair of transversely opposed, metallized slots passing through said dielectric body in the thickness direction thereof from an opening formed on a metallized portion of said first surface of said dielectric body toward an opposed opening on a metallized portion of said second surface of said dielectric body, wherein each of said pair of metallized slot extends a distance in the transverse direction of said dielectric body from a respective one of said openings on a respective one of said first and said second surfaces of said dielectric body toward a blind end thereof to define a length dimension of said pair of metallized slots, and wherein each of said pair of metallized slots extends a distance in the longitudinal direction of said dielectric body to define a width dimension of said slot, and (ii) a metallized through hole passing through at least a central portion of said dielectric body in the thickness direction thereof from an opening formed on said first surface of said dielectric body to an opposed opening on said second surface of said dielectric body, said metallized through hole having a length dimension defined in the transverse direction of said dielectric body and a width dimension defined in the longitudinal direction of said dielectric body.

5. The wideband dielectric waveguide cavity filter according to claim 4, further comprising at least one metallized, transverse slot defining an opening formed in the other one of said first surface and said second surface of said dielectric body in at least a central portion of at least one of said two or more resonator sections.

6. The wideband dielectric waveguide cavity filter according to claim 5, wherein said at least one metallized transverse slot spans the width dimension of said dielectric body and extends from an opening on one of said pair of transversely longitudinal sides of said dielectric body toward an opposed opening on the other one of said pair of transversely opposed longitudinal side surfaces of said dielectric body.

7. The wideband dielectric waveguide cavity filter according to claim 5, wherein said two or more resonator sections comprises at least three resonators.

8. The wideband dielectric waveguide cavity filter according to claim 3, wherein said two or more resonator sections comprises at least three resonators.

9. The wideband dielectric waveguide cavity filter according to claim 7, wherein said at least one transverse slot is located in an intermediate one of said at least three resonators that is positioned remotely from said first and second end surfaces of said dielectric body.

10. A wideband dielectric waveguide cavity filter comprising:

a sintered dielectric block having an outer surface extending from a first end to an opposed second end thereof in a longitudinal direction and having a width defined in a transverse direction that is substantially perpendicular to said longitudinal direction;

a metal layer substantially covering said outer surface of said sintered dielectric block and defining a pair of longitudinally opposed, electrically isolated contact pads on a first main portion of said outer surface of said sintered dielectric block proximate a respective one of said first and said second ends of said dielectric block;

a pair of longitudinally opposed metallized blind holes extending inwardly from an opposed second main portion of said outer surface of said sintered dielectric block and directly opposing a respective one of said pair of contact pads on said first main portion; and a plurality of adjacent resonator sections defined by said sintered dielectric block and bounded by said metal layer, said plurality of adjacent resonator sections being transversely separated from one another and coupled to one another through coupling means disposed between adjacent ones of said plurality of resonator sections, said coupling means being defined by one of (i) a pair of metallized, transversely opposed slots that each pass from said first main portion of said outer surface to said second main portion of said outer surface of said sintered dielectric block in a thickness direction thereof and that each extend inwardly toward one another a distance across a substantial portion of said width of said dielectric block in the transverse direction from an opening on respective ones of a first side portion of said outer surfaces of said sintered dielectric block and a transversely opposed second side portion of said outer surface of said sintered dielectric block and (ii) a metallized through hole passing from an opening on said first main portion through said sintered dielectric block toward an opposed opening on said second main portion of said outer surface of said sintered dielectric block and extending a distance in the transverse direction across a substantial portion of said width of said dielectric block.

11. The wideband dielectric waveguide cavity filter according to claim 10, wherein a first one of said pair of contact pads and a first one of said pair of metallized blind holes are disposed on a first outermost one of said plurality of adjacent resonator sections proximate one of said first and said opposed second ends of said sintered dielectric block, and wherein the other one of said pair of said contact pads and the other one of said pair of metallized blind holes are disposed on a second outermost one of said plurality of adjacent resonator sections proximate the other one of said first and said opposed second ends of said sintered dielectric block.

12. The wideband dielectric waveguide cavity filter according to claim 10, wherein said coupling means comprises said metallized through hole.

13. The wideband dielectric waveguide cavity filter according to claim 10, wherein said coupling means comprises said pair of metallized, transversely opposed slots.

14. The wideband dielectric waveguide cavity filter according to claim 10, further comprising at least one metallized, transverse slot defining an opening formed in said second main portion of said outer surface of said sintered dielectric block in at least a central portion of at least one of said plurality of adjacent resonator sections.

15. The wideband dielectric waveguide cavity filter according to claim 14, wherein said at least one metallized, transverse slot spans the width dimension of said sintered dielectric block and transversely extends from an opening on one of the transversely opposed first and second side portions of said sintered dielectric block toward an opposed opening on the other one of the transversely opposed first and second side portions of said sintered dielectric block.

16. The wideband dielectric waveguide cavity filter according to claim 10, wherein said plurality of adjacent resonator sections comprises at least three resonator sections.

17. The wideband dielectric waveguide cavity filter according to claim 14, wherein said plurality of adjacent resonator sections comprises at least three resonator sections.

18. The wideband dielectric waveguide cavity filter according to claim 17, wherein said at least one transverse slot is provided in at least a central portion of an intermediate one of said plurality of adjacent resonator sections located between ones of said plurality of adjacent resonator sections that define opposed outermost resonator sections nearest said first and said second ends of said dielectric block.

* * * * *

UNITED STATES PATENT AND TRADEMARK OFFICE

CERTIFICATE OF CORRECTION

PATENT NO. : 7,956,708 B2
APPLICATION NO. : 12/353442
DATED : June 7, 2011
INVENTOR(S) : David Allen Bates et al.

It is certified that error appears in the above-identified patent and that said Letters Patent is hereby corrected as shown below:

Column 12

*Line 10:* please add --opposed-- after "transversely"

*Line 48:* please add --adjacent-- after "plurality of"

Signed and Sealed this
Twentieth Day of September, 2011

David J. Kappos
*Director of the United States Patent and Trademark Office*